United States Patent [19]

Morris

[11] 4,109,619

[45] Aug. 29, 1978

[54] FLOW CONTROL INSERT FOR INTERNAL COMBUSTION ENGINE INTAKE MANIFOLDS

[75] Inventor: George O. Morris, Newport Beach, Calif.

[73] Assignee: Fred C. Offenhauser, Newport Beach, Calif. ; a part interest

[21] Appl. No.: 640,234

[22] Filed: Dec. 12, 1975

[51] Int. Cl.[2] ..... F02B 75/18

[52] U.S. Cl. ..... 123/52 R; 123/52 M; 123/141

[58] Field of Search ..... 48/180; 123/141, 52 M, 123/52 R

[56] References Cited

U.S. PATENT DOCUMENTS

| | | | |
|---|---|---|---|
| 2,027,480 | 1/1936 | Higley | 48/180 R |
| 2,587,360 | 2/1952 | Milbrath | 123/141 |

FOREIGN PATENT DOCUMENTS 982,461 8/1963 United Kingdom.

*Primary Examiner*—Ronald H. Lazarus

*Attorney, Agent, or Firm*—Donald D. Mon

[57] ABSTRACT

An insert for the receiver of an intake manifold for an internal combustion engine. The receiver receives air/fuel mixture from a carburetion system, usually from a plurality of carbueretor barrels, and runners exit from the receiver to conduct the mixture to respective cylinders. The insert, which can be of a selectible or adjustable contour, serves to direct the flow of mixture to the various runners in accordance with the demands of the respective cylinders. Correct selection of insert contour and size enables an individual manifold configuration to be adapted to the unique airflow pattern and volumetric requirements of an individual engine, rather than to an average engine, and also to specific performance ranges, rather than to a wider average performance range. The insert can also be movably mounted to provide for various load conditions. The invention comprehends the combination of the insert and a manifold. The invention also comprehends an insert which does not divide the charge among runners, but instead specifically affects the supply to an individual runner.

31 Claims, 27 Drawing Figures

FLOW CONTROL INSERT FOR INTERNAL COMBUSTION ENGINE INTAKE MANIFOLDS

This invention relates to an internal combustion engine intake manifold system, and in particular to an insert for the receiver of such a manifold which insert serves to adapt a specific manifold to the requirements of an individual engine.

Internal combustion engine manifolds are difficult and expensive to design and manufacture. Because they are usually made of cast metal, their configuration is not adjustable after they are made. Therefore a manifold is designed to suit the average requirements of a type of engine or of a group of engine types over a wide range of operating conditions. It is well known that this compromise involves disadvantages, because the optimum airflow patterns and volumetric requirements of an engine at one engine speed and load will be considerably different from the optimum conditions at some other engine speed and load. Also, individual engines of the same type may differ from one another because of inherent construction tolerances, and because of their individual modifications. For these reasons, manifolds are often specially designed for street use, for racing use, for drag use, and for other specialized situations. Manifolds are difficult things to remove and replace and are rarely changed when the usage is temporarily changed. Accordingly, a vehicle having its engine equipped with manifold for one use is very clumsy and inept at engine speeds and loads other than those for which the manifold is specifically designed. For example, a vehicle equipped with a racing manifold performs very poorly on the street at moderate and idling velocities and loads.

Furthermore, even when using a manifold intended for a narrow range of conditions on an engine, one encounters the fact that the engines themselves, even of the same type, differ considerably because of the individual settings and modifications of the respective engine. For example, there can be variations in cam timing, changes of head porting, compression ratio changes, and engine boring changes. These all affect the engine's breathing characteristics. Accordingly, a manifold which might be very suitable for an average engine of a given type may, because a particular engine's characteristics have been changed, be relatively unsuitable for that particular engine, if maximum performance is anticipated.

It is an object of this invention to provide means for adapting an engine manifold to the breathing requirements of a respective engine without having to change manifolds or to change their configuration. This is accomplished by providing an insert in the receiver of the manifold which occupies space in the receiver and which directs the stream of fuel/air mixture to the respective runners in an optimum pattern. It is well known that the provision of a receiver in a manifold is a compromise in itself and often represents a relatively dead region in the system. By occupying useless volume in the receiver, the insert reduces the unfavorable characteristics of the receiver, and by appropriately deflecting the incoming stream of air/fuel mixture it can maintain the velocity of the stream, provide the proper volumetric division to the respective cylinders, and even provide for standing waves to improve the sonic tuning of the engine.

This invention also comprehends an insert which is placed in the flow path of only one runner, where it optimizes the size, shape and characteristics of a single path instead of a plurality of paths.

An insert according to this invention is adapted to be placed in the receiver of a manifold beneath an upper inlet opening from the carburetion system. The receiver customarily but not necessarily has a plurality of exit openings going to the respective runners. The insert has lateral dimensions which divide the flow of mixture from the inlet opening into a plurality of streams, and has a lower portion with peripheral dimensions to direct the respective streams toward respective exit openings.

According to a preferred but optional feature of the invention, the lower portion is concave in horizontal planes so as gradually to deflect the stream toward the respective exit openings.

According to another preferred but optional feature of the invention, the insert is made of material which can be shaped by hand tools so that its contour can be changed to suit the requirements of individual engines.

The above and other features of this invention will be fully understood from the following detailed description and the accompanying drawings in which:

FIG. 1 is a top view of one half of a well-known manifold in which this invention is useful. The remaining unillustrated one half is below that shown in FIG. 1 and is its mirror image;

FIGS. 2 and 3 are cross-sections taken at lines 2—2 and 3—3 respectively in FIG. 1;

Figure 7:
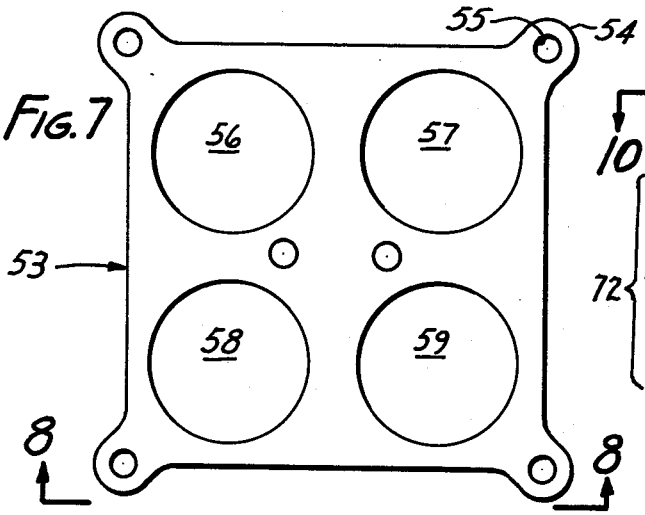
FIG. 7 shows an adapter plate useful with this invention.
Figure 8:
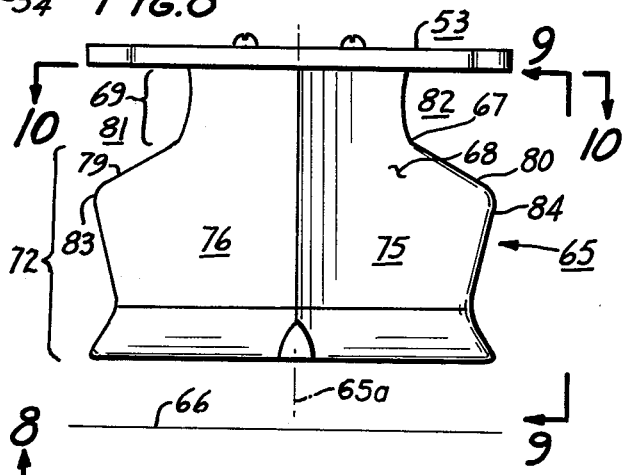
FIG. 8 shows the presently preferred embodiment of insert mounted to the system by attachment to the adapter plate.
Figure 9:
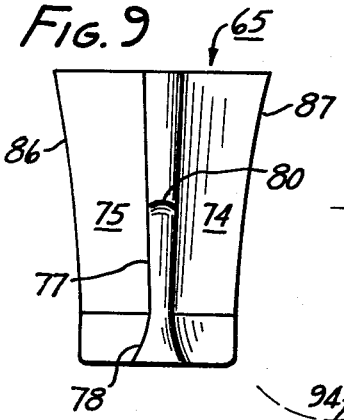
Figure 10:
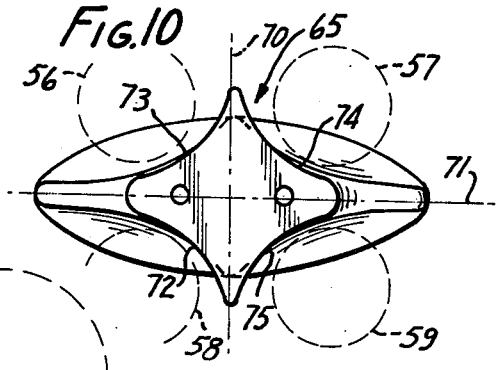
Figure 11:
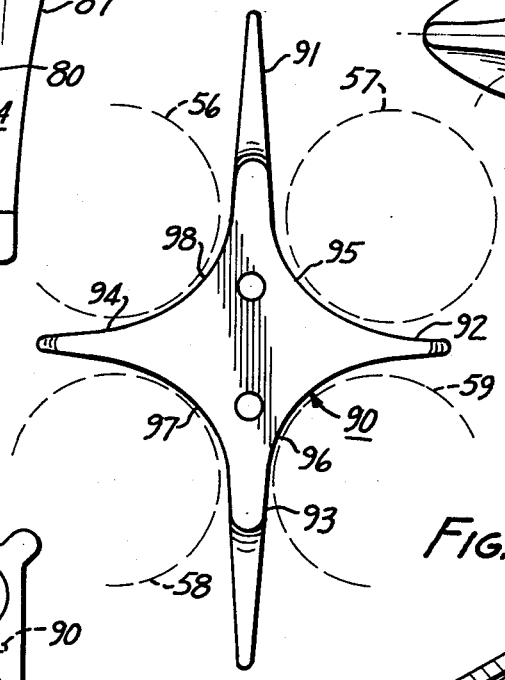
Figure 12:
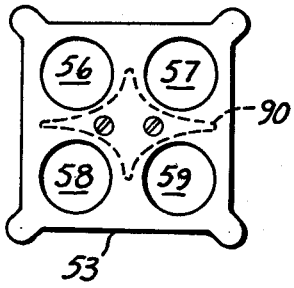
Figure 13:
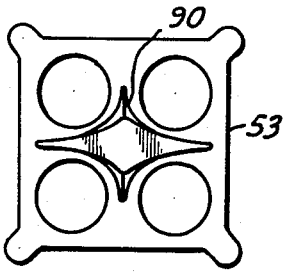
Figure 14:
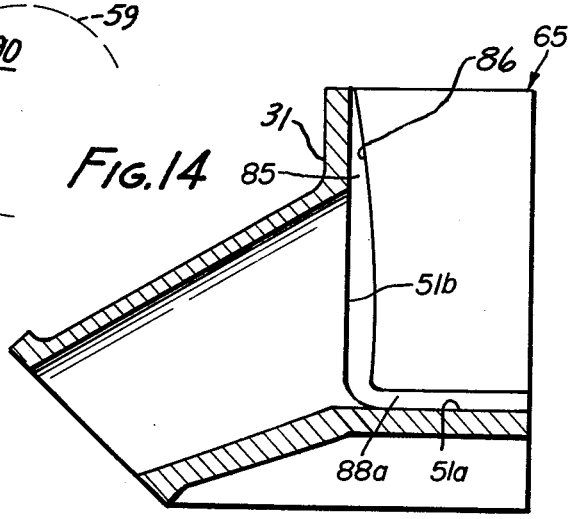
Figure 15:
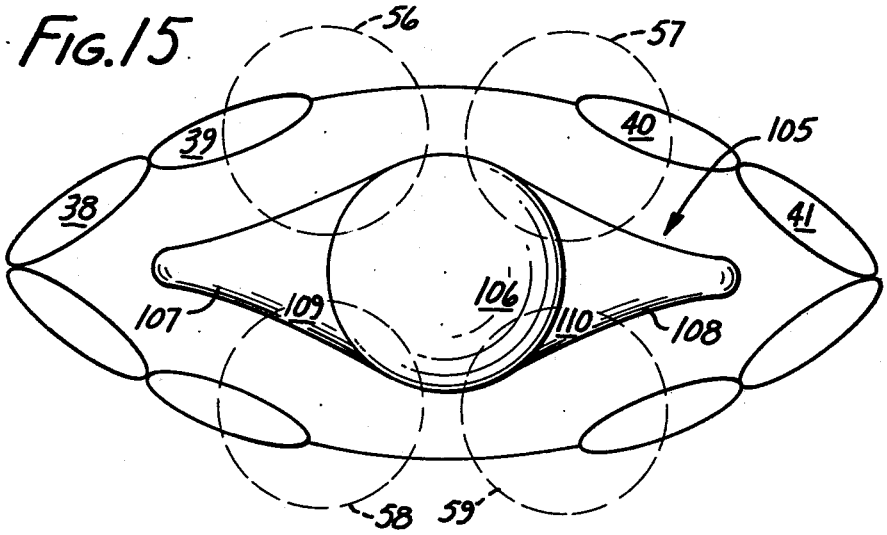
Figure 16:
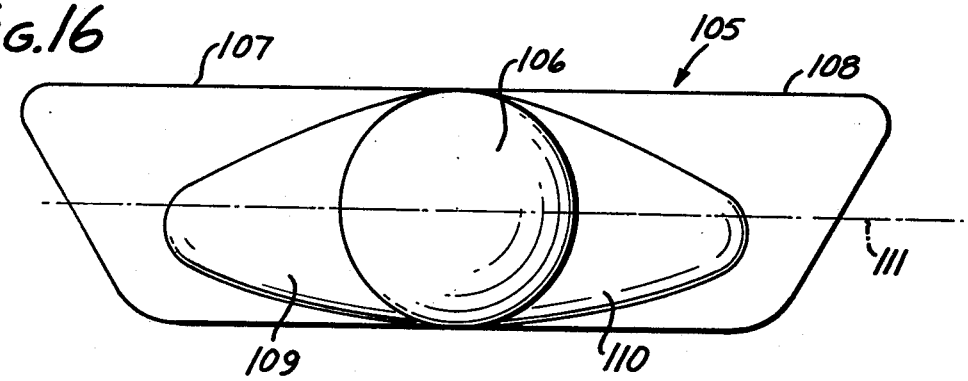
Figure 17:
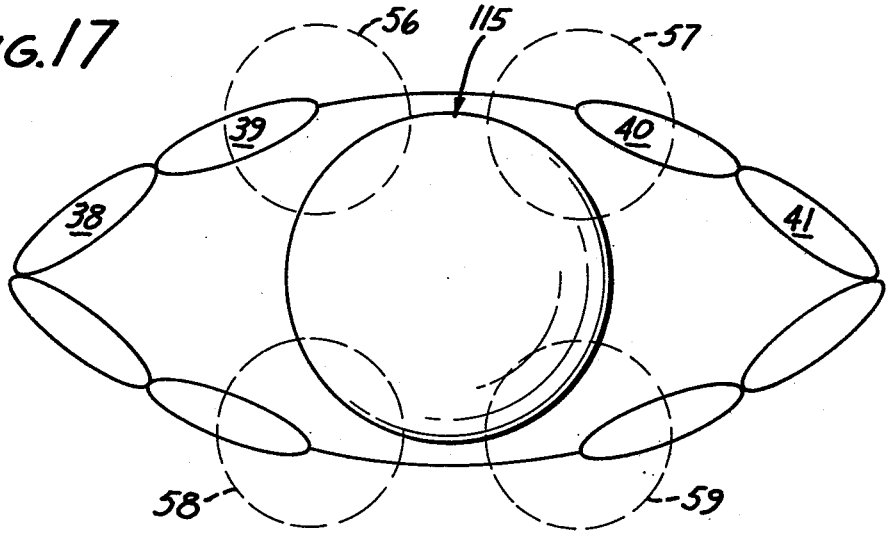
Figure 18:
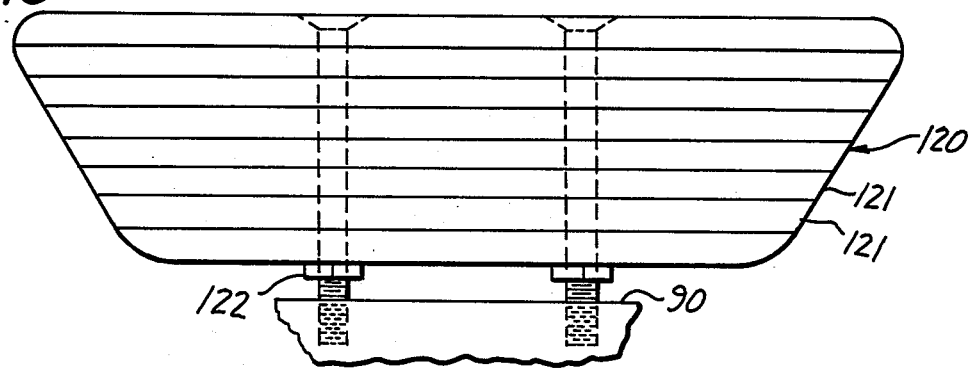
Figure 19:
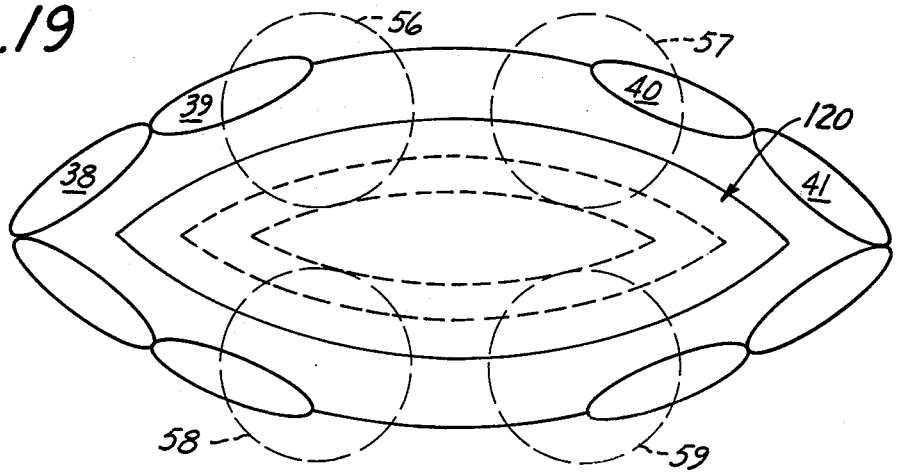
Figure 20:
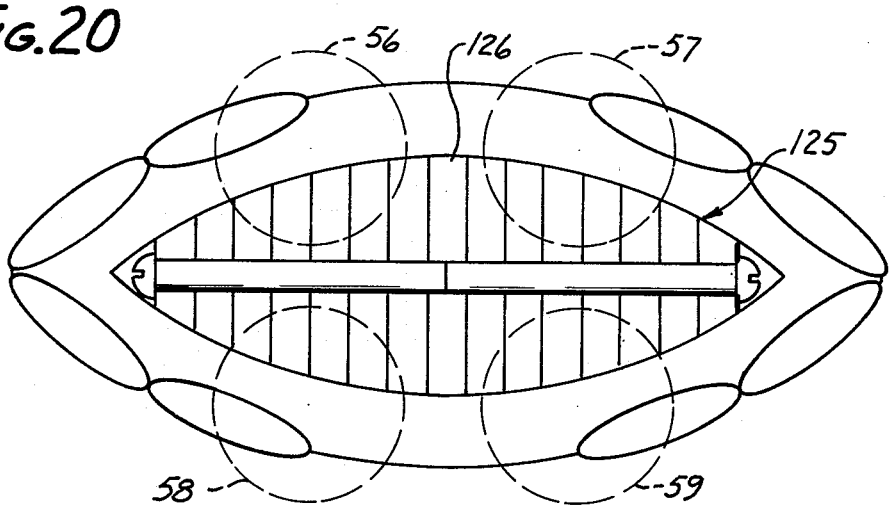
Figure 21:
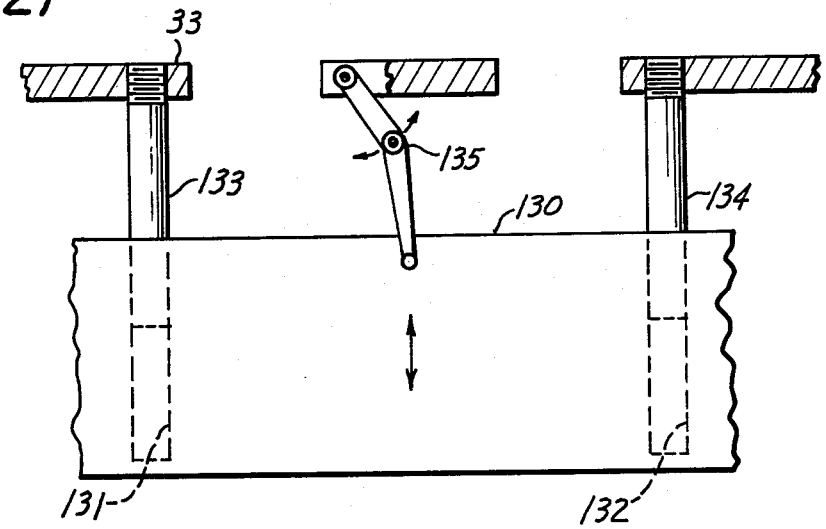
Figure 22:
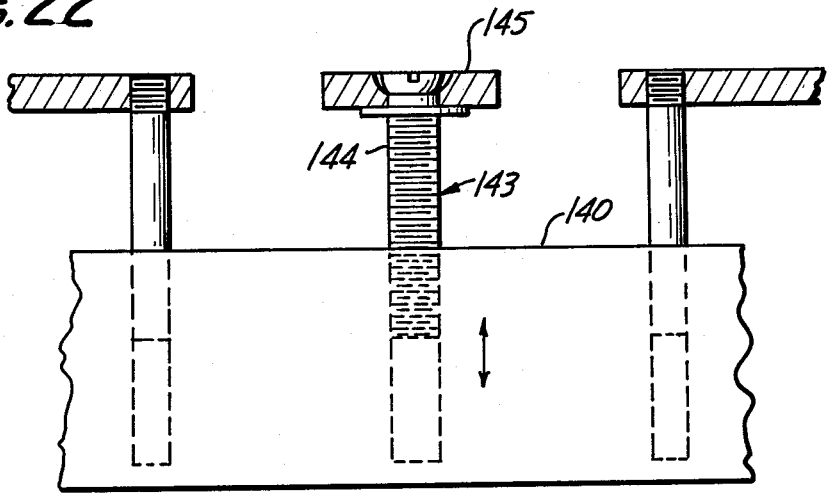
Figure 23:
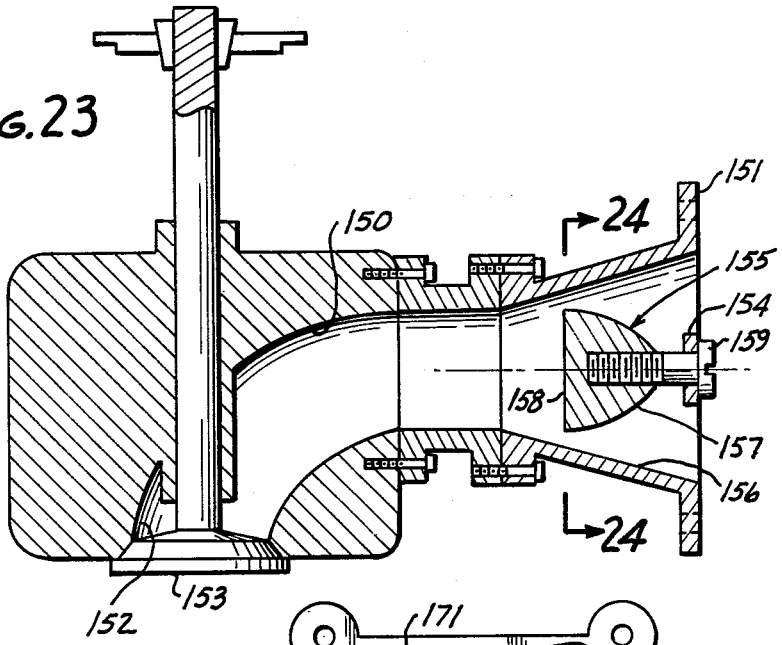
Figure 24:
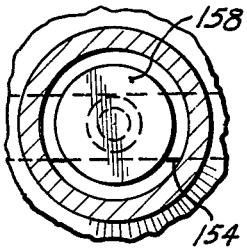

FIGS. 9 and 10 are views taken at lines 9—9 and 10—10 respectively in FIG. 8;

FIG. 11 is a top view of another embodiment of the invention;

FIG. 12 shows the embodiment of FIG. 11 mounted to the adapter plate of FIG. 7;

FIG. 13 is a bottom view of FIG. 12;

FIG. 14 is a fragmentary view showing a preferred relationship between an insert and the receiver;

FIGS. 15 and 16 are top and side views respectively of another embodiment of the invention;

FIG. 17 is the top view of still another embodiment of the invention;

FIGS. 18 and 19 are respectively side and top views showing a means of making any embodiment of the invention;

FIG. 20 is a top view of another construction suitable for any embodiment of the invention;

FIGS. 21 and 22 are fragmentary views showing means for movably mounting any insert according to the invention;

FIG. 23 is an axial cross-section of an insert and single-runner;

FIG. 24 is a cross-section taken at line 24—24 of FIG. 23; and

Figure 1:
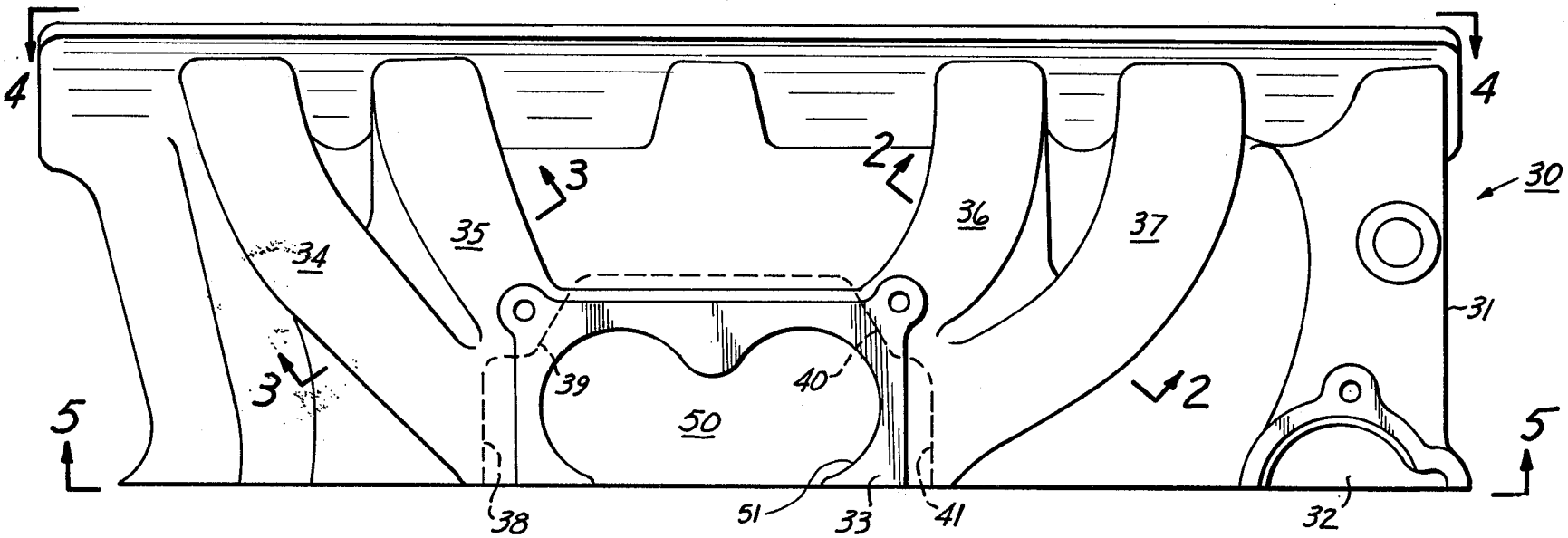
Figure 25:
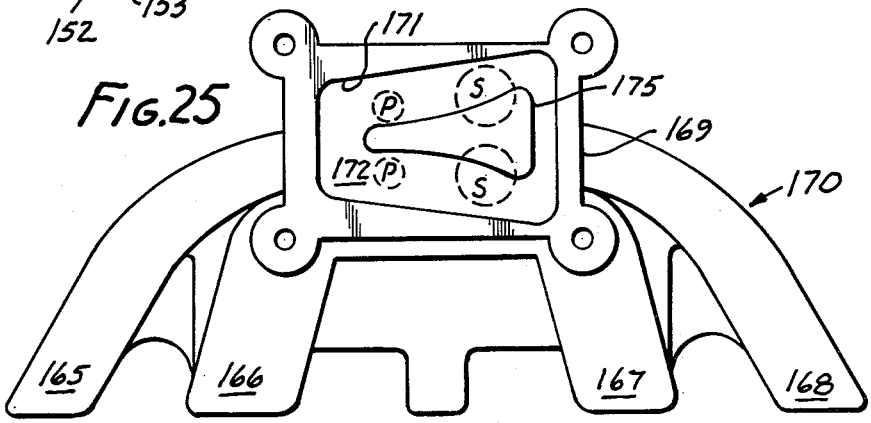
Figure 26:
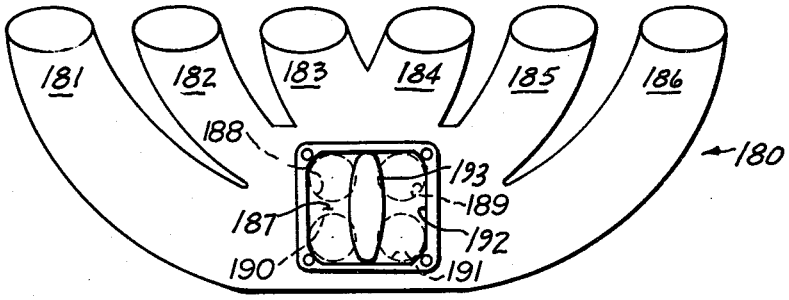
Figure 27:
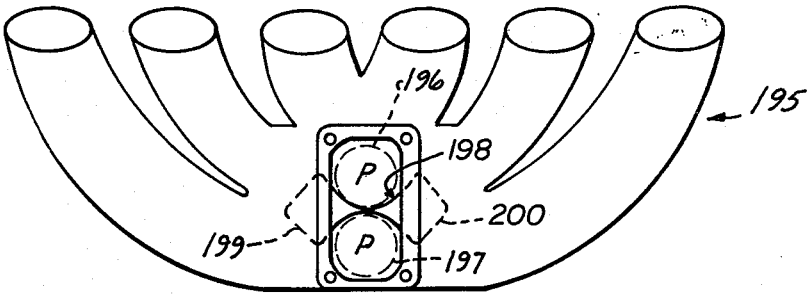

FIGS. 25–27 are semi-schematic illustrations of devices according to this invention wherein all runners are on but one side of the insert, rather than on both sides, for example a straight 4 or 6 cylinder installation, rather than a V type;

FIG. 1 shows an intake manifold 30 for an internal combustion engine (not shown). The manifold includes a body 31 which generally is cast from iron or aluminum. Persons skilled in the art will recognize this as a conventional manifold with a heater passage 32 and a carburetor mounting pad 33.

Figure 4:
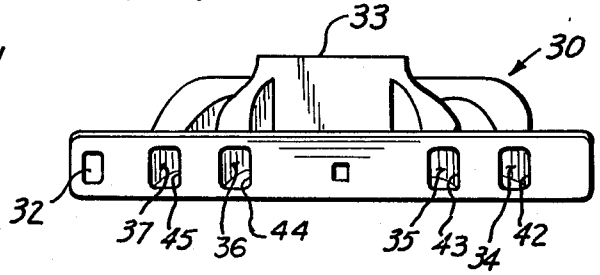
FIG. 4 is a side view taken at line 4—4 of FIGl 1.
Figure 2:
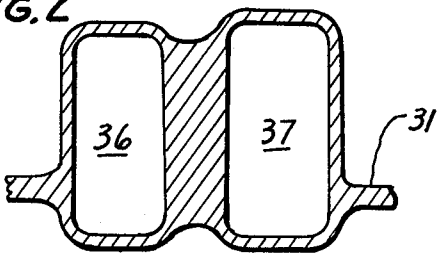
Figure 3:
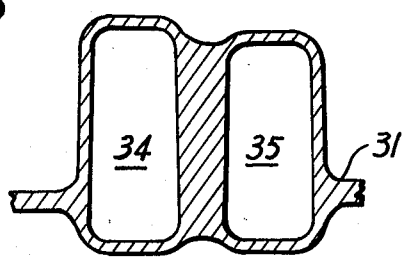
Figures 5, 6:
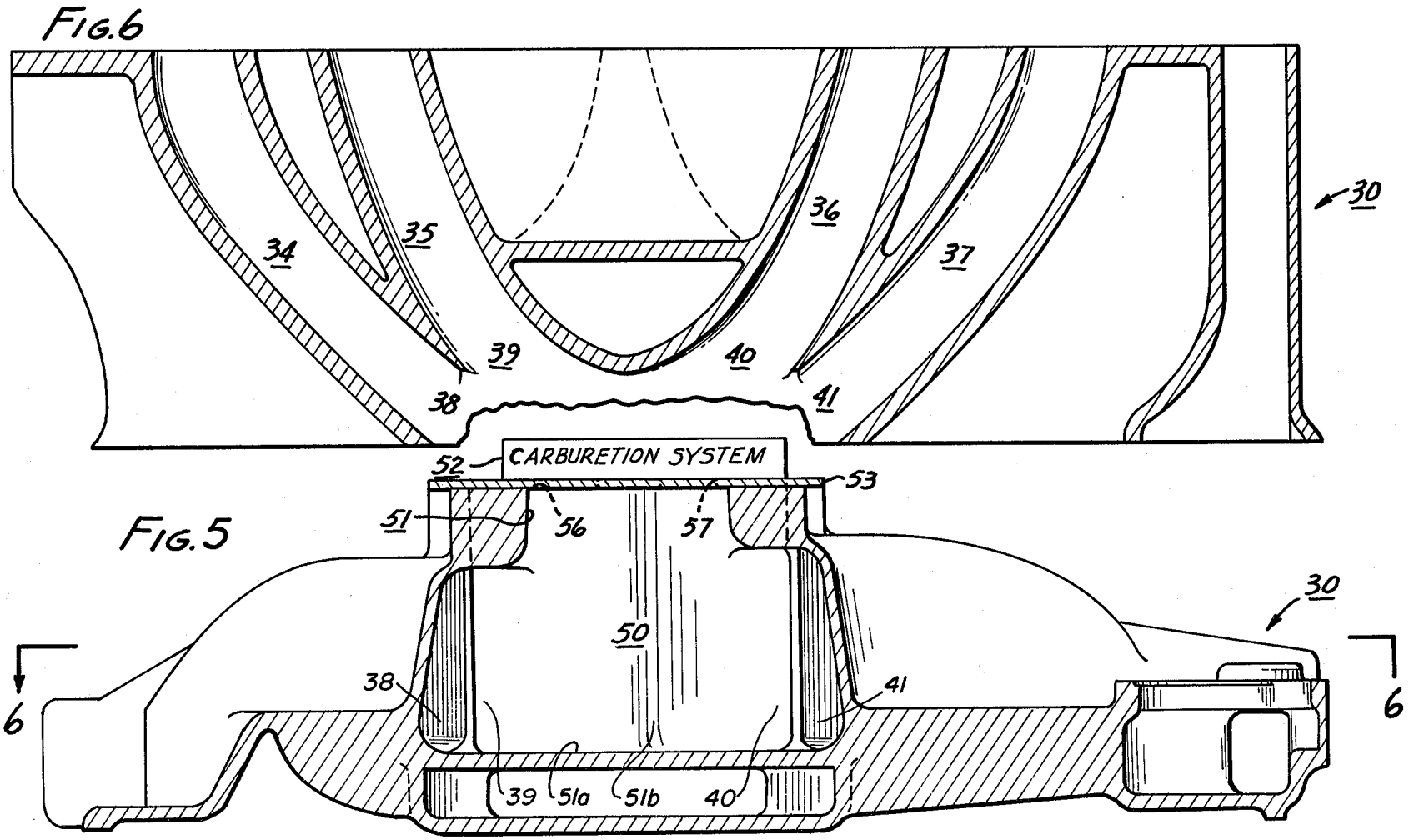
FIG. 5 is a cross-section taken at line 5—5 of FIG. 1.
FIG. 6 is a cross-section taken at line 6—6 of FIG. 5.

The manifold shown is specifically intended for use with a V-8 engine. Four runners 34, 35, 36, 37 are shown. In FIG. 1 only the external outline of the runners is evident. These extend from exit openings 38, 39, 40, 41 to outlets 42, 43, 44, 45 (FIG. 4). Outlets 42–45 will communicate with intake ports of respective engine combustion chambers. The exit openings 38–41 open into a receiver 50 (FIG. 5). This pattern is duplicated on both sides of the section line 5—5, the entire assembly not being shown in order to simplify the drawings.

The receiver has an upper inlet opening 51 through which fuel/air mixture is received from a carburetion system 52 such as a four-barrel carburetor (not shown) mounted to mounting pad 33. The receiver has a bottom wall (sometimes called a "lateral wall") 51*a*, and a peripheral sidewall 51*b*. The details of the carburetor are not essential to an understanding of this invention. The device shown customarily functions best with a four-barrel carburetor. An adapter plate 53 best shown in FIG. 7, has ears 54 with holes 55 to pass fasteners (not shown) to mount the plate to the carburetor mounting pad. The adapter plate is placed between the mounting pad and the carburetion system, and functions as an extension of the mounting pad.

Four ports 56, 57, 58, 59 are provided to receive the output of respective barrels. The outlines of ports 56–59 are shown in various other of the illustrations herein. It is the purpose of the insert of this invention to divide the flow as received by the upper inlet opening 51 either in one or in a plurality of streams so as optimally to divide and to direct the stream through the receiver to the respective runners. In some embodiments it also affects the sonic characteristics of the system.

The presently preferred embodiment of the invention is shown in FIGS. 8 and 9 as insert 65. This insert extends along a generally vertical axis 65*a* relative to the horizontal 66. The insert comprises a body 67 which occupies space in the receiver. The body has a boundary surface 68 with its portion 69 nearest the inlet opening having lateral dimensions (the term lateral meaning measurement in the horizontal dimension) which divide the flow of mixture into a plurality of streams. The streams are not necessarily discretely separated, although they could be. Actually, it is preferred that there be communication between them.

The streams may be received individually from the four ports 56–59, or as a single stream from the inlet opening 51 as desired. The boundary surface preferably will not impede the flow of mixture, but instead will divide and direct it, and for this purpose a plurality of openings are advantages. By its shape and size, the insert can affect the volume which can flow through the receiver, thereby regulating the supply to the respective runners.

The insert as initially provided and before being modified will customarily be symmetrical around a pair of horizontal axes 70, 71 as shown in FIG. 10. The overlaying ports 56–59 are schematically shown, looking down onto the insert from the carburetion system. At a lower portion 72 the peripheral dimensions are such as to direct the respective streams toward respective exit openings. In the embodiment of FIGS. 8–10, the lower portion is generally concave in a vertical plane. This is to say that a vertical plane passed through any of the "cusps" 73, 74, 75, 76 will be generally scooped or concave. This is accomplished by a combination of a generally tapered region 77 and an outwardly scooped foot 78 as shown. This contour will cause the mixture smoothly to be deflected toward the runners. In this embodiment, the cusps are also concave in a horizontal plane. The intersections of horizontal planes with the insert form concave curved lines.

It is useful to balance pressure and flow conditions between at least some of the regions, and for this reason shoulders 79, 80 are provided on the body so as to leave open regions 81, 82 across blades 83, 84. As best shown in FIG. 14, an open region 85 can be provided between the peripheral sidewall and blades 86 and 87 for restricted communication across those plates, also. In addition, the insert can be mounted to leave a clearance 88*a* between itself and the wall (lateral wall) 51*a* of the receiver for the same purpose.

FIG. 11 shows an insert 90 which is generally prismatic. This is to say that a vertical plane through the insert intersects only straight lines at its surface which are parallel to the axis of the flow (axis 65*a*, for example). This insert comprises blades 91, 92, 93, 94 which form cusps 95, 96, 97, 98 whose surfaces are generally parallel to the vertical axis. This may also be attached to the adapter plate 53, as in the case of FIG. 8. Also, as in the insert of FIG. 8, the bottom surface of the insert may be spaced from the bottom surface 90 of the receiver so as to leave a clearance which may be used for balancing purposes.

FIG. 15 shows an insert 105 which has convex elements. This serves to illustrate that the insert may be concave, prismatic, convex, or any combination thereof. In this embodiment a ball-like member 106 is incorporated in the insert whose lateral dimensions diminish toward the top to serve to divide the streams. Only two blades 107, 108 are used in this embodiment. The division on each side of these blades is made by the ball-like center and a pair of tapered mound-like rises 109, 110. All of these elements fair smoothly into one another. This construction shows that division of flow can nicely be made with convex elements, and with the further advantage that those convex elements below a center line 111 form an overhanging deflector facing ("leaning") downwardly toward at least a portion of the exit port. This may be quite convenient in designing an insert for reflecting sound waves from the runners.

FIG. 17 shows an insert 115 in the shape of a ball evenly dividing the stream. It forms an overhanging deflector below its center for the purpose described with respect to FIG. 15. Basically, this is the insert of FIGS. 15–16 without the blades.

The inserts are preferably made to their contours can be changed by the user. The insert will preferably be made of materials which can be worked (shaped) by hand tools. Suitable materials are soft iron, aluminum, plastics, wood, or other soft materials which are resistant to the fuel/air mixture. Such materials would not include hard-tempered steels and the like. The hand tools referred to are such as knives, chisels, rotating burrs and end mills, and the like, such that a user may begin with a basic shape provided to him and which shape will be on the larger side, and then may fine tune the construction by whittling it or otherwise trimming it to his satisfaction. The term "hand tool" means hand-held, as opposed to convention floor mounted machine tools such as mills and lathes. Obviously a hand-held end motor powered end mill is a very suitable tool for the purpose.

Alternately, the insert can be provided in the form of a stack of laminations, which lamination can be exchanged for others of more suitable configuration for the particular installation. In FIG. 18 there is shown an insert 120, which may be of a surface configuration such as any of the foregoing embodiments. It comprises a stack of plates 121 held together by releasable fasteners 122, which may be attached to the bottom of the receiver. All the user has to do to alter the shape is remove the fasteners, separate the plates, put in plates he prefers, and reassemble the device. In FIG. 18 the plates are horizontal. In FIG. 20 an insert 125 is shown with vertical lamination plates 126 in a stack. Again, any desired configuration can be assembled. In both embodiments, the contour of individual plates can be changed one by one. This enables a person to correct local obstacles without having to start all over again.

FIGS. 21 and 22 illustrate that any of these inserts can be made undersized relative to the vertical dimension of the receiver, and may be moved up and down so as to position the deflecting surfaces, and also the bypass passages, relative to the bottom surface, top surface and sidewall of the receiver. The clearances are thereby set to best advantage. FIG. 21 shows an insert 130 of any desired type having guide passages 131, 132 to receive guide pins 133, 134 that are attached either to the adapter plate or to the manifold body. An elevation-adjusting means comprising a linkage 135 which may be throttle-controlled, controlled by manifold pressure, or manually controlled, raises and lowers the insert as a function of engine output or individual preference. This provides for a running adjustment of the clearances between the insert and the boundary walls of the receiver.

FIG. 22 shows an insert 140 provided with guide means 141, 142 as in FIG. 21. In this construction, the elevation adjusting means 143 is a lead screw 144. The lead screw is threaded into the insert and is rotatably mounted to a support plate 145. Turning the screw one direction or the other will raise or lower the insert for the purposes already discussed.

FIG. 23 illustrates the invention used to trim the performance of a single runner or inlet pipe, instead of a plurality of them. An inlet pipe 150 (sometimes called a "runner") extends from a carburetor mounting pad 151 to the intake port 152 of an engine cylinder. This is a conventional installation where each cylinder has its own carburetion system. Intake valve 153 is also illustrated. A spider 154 extends across the runner and supports an insert 155 in a tapering enlarged section 156 of the inlet pipe. This section substitutes for the receiver in the other embodiments. Its upstream-facing boundary 157 is generally circular in plan, and convexly coned. Its base 158 is flat. The surface configuration of the boundary 157 optimally directs the air/fuel mixture into the runner, and the base serves to reflect sound waves to acoustically tune the system. The axial location of the insert can be adjusted by the mounting screw 159. The size and contour can be hand-worked as in other embodiments. The illustration is of a side-draft carburetion system, illustrating that the orientation of the flow axis is immaterial to the function of the invention.

FIGS. 25–27 show the division of streams to one side only, rather than to both sides, of the receiver. FIG. 25 shows four runners 165, 166, 167, 168 supplying the four cylinders of a straight four cylinder engine. A carburetor mounting pad 169 is shown on manifold 170. Entry port 171 is somewhat tapered, and the two primary and two secondary barrels, P and S, are shown in a conventional orientation above receiver 172. A prismatic insert 175, or insert according to any of the other embodiments is shown. However, whatever insert is used should have a configuration which tapers in the horizontal plane as shown, more effectively to divide and distribute the outputs of the primary and secondary barrels. It is interesting to observe that even through the primary barrels are closer to runners 165 and 166 than to barrels 167 and 168, an insert shaped as shown appears to give a better distribution than the receiver without it. Appropriate side or end clearances can be provided for balancing flow around the insert.

FIG. 26 shows a manifold 180 for use with a straight 6 cylinder engine (not shown). It includes runners 181, 182, 183, 184, 185 and 186 which depart from receiver 187. Two primary carburetor barrels 188, 189 and two secondary barrels 190, 191 are shown superimposed on inlet port 192. Insert 193 is placed inside the receiver. It is lozenge-shaped in cross-section and serves generally to divide the streams to two sets of three cylinders.

FIG. 27 shows a similar 6 cylinder engine 195 wherein two primary barrels 196, 197 discharge into a receiver. A bifurcated insert 198 with two lobes 199, 200 is mounted in the receiver. It is shown as a prismatic insert with edge clearances. There may also be bottom and top clearances if desired. Any of the types of surfaces — concave, convex, prismatic or combined, can be used. The drawing is intended to show the lobe characteristic as another means for dividing flow. This is especially useful for straight-line installations where the receiver does not discharge symmetrically from two sides, but may find application in some two-sided installations.

The terms "cusps" is sometimes used interchangeably with "deflector regions".

In the specification and claims, terminology is used to the effect that the portion of the insert nearest the inlet opening has lateral dimensions which with the sidewall of the receiver distributes the flow of mixture from the inlet opening to the exit ports. This portion is that which is initially encountered by the mixture. It extends axially as far as necessary to cause the mixture to flow at correct quantities and velocities to each of the exit ports. The terminology is also used that the portion which is remote ("remote portion") from the exit port has a conformation to encourage flow of mixture through the exit ports.

In FIG. 8, the nearest portion is that above the foot. The remote portion is the foot 98 which deflects the stream toward the exit ports, and perhaps some of the lower part of the side surfaces which might set up a standing wave in the runner.

In FIG. 11, the nearest portion is the upper part of the sides, and the remote portion is the bottom part of them, where the flow to the exit ports is backed up by the surface, and perhaps a standing wave is set up in the runners.

In FIGS. 15–17, the nearest portion is above the "belt" of the insert, and the remote portion is below, where it backs up flow to the runners and perhaps sets up a standing wave.

In FIGS. 18–20, the nearest portion is at a band at the wide part, and the remote portion is below it, where it backs up flow to the runners, and perhaps sets up a standing wave in the runners.

A standing wave can be encouraged by forming a configuration which reflects a sonic wave in the runner at approximate velocities. This, as well as optimum distribution of mixture, can be sought by trimming the insert until the performance is optimized.

The "distribution" of mixture referred to herein, results from lateral dimensions of the insert which are such that appropriate quantities respective to the cylinders are supplied through the receiver.

This invention thereby provides an insert means and also provides the combination of a manifold having a receiver with an insert means, whereby the internal configuration of the receiver is modified, perhaps adjustably or selectively, so as to provide an optimal distribution of an incoming air/fuel mixture to the various runners. The shape of the various cusps can be independently varied relative to one another. The insert itself can be moved bodily up and down. The deflecting surfaces may be concave, prismatic, convex or any combination thereof suited to the conditions that are to be optimized.

Speaking generally, the insert should not reduce the volume of the respective paths below that which is required to let the engine have the charge it requires at the engine speeds and loads under consideration. The surfaces may to advantage be so disposed and arranged as to provide a standing wave in the runner which will encourage the passage of the mixture through the runner by being placed where they will reflect a wave into the runner. The device can readily be adapted to adjustment for various operating conditions even on a running basis. This can all be provided in a means which can readily be worked on and changed in shape by a mechanic, and can result in optimized performance for many engines using but a single basic manifold configuration.

This invention is not to be limited by the embodiments shown in the drawings and described in the description which are given by way of example and not of limitation, but only in accordance with the scope of the appended claims.

I claim:

1. An insert for the receiver of a manifold which receives fuel/air mixture and in turn supplies the mixture through a plurality of runners to respective internal engine combustion chambers, the receiver having an inlet opening, a bottom wall and a sidewall, the runners having exit openings in the sidewall spaced apart from one another around the receiver and below the inlet opening, said insert comprising: a body having a boundary surface in the path of mixture flowing into the receiver from the inlet opening and having an axis facing toward and substantially aligned with said incoming mixture, the portion of the boundary surface which is to be placed nearest to said inlet opening having a surface perimeter extends in planes normal to said axis, which surface is non-circular and and at least in part relieved to form concave curved lines with said normal planes in order to form with the sidewall a plurality of paths for flow of said mixture, the portion of the boundary surface which is to be remote from the inlet opening having a surface configuration to encourage flow of mixture through the exit ports.

2. An insert according to claim 1 in which the remote portion is generally concave in horizontal planes.

3. An insert according to claim 1 in which the remote portion is generally concave in vertical planes.

4. An insert according to claim 1 in which the remote portion is generally concave in both horizontal and vertical planes.

5. An insert according to claim 1 in which the remote portion includes a plurality of spaced-apart deflector regions which are generally concave in horizontal planes.

6. An insert according to claim 1 in which the remote portion includes a plurality of spaced-apart deflector regions which are generally concave in vertical planes.

7. An insert according to claim 1 in which the remote portion includes a plurality of spaced-apart deflector regions which are generally concave in both horizontal and vertical planes.

8. An insert according to claim 1 in which the remote portion is generally prismatic.

9. An insert according to claim 1 in combination with means adjustably to move the insert up and down in the receiver.

10. An insert according to claim 9 in which said means is a lever system.

11. An insert according to claim 9 in which said means is a lead screw.

12. An insert according to claim 1 in which the insert is made of material which can be shaped by hand tools.

13. An insert according to claim 1 in which the surface perimeter of the insert includes a plurality of shoulders disposed downwardly from the top of the insert to provide for a by-pass flow of mixture from side to side of the insert.

14. An insert according to claim 1 wherein the exit openings are non-symmetrically disposed in said sidewall relative to the axis of flow of mixture, and in which the contour of the insert is as to suitably distribute the flow of mixture among the runners.

15. An insert according to claim 14 in which said insert is tapered laterally relative to the axis of flow of mixture from the inlet opening.

16. An insert according to claim 14 in which the insert includes a pair of lobes.

17. In combination: an intake manifold for an internal combustion engine, which manifold includes a receiver that receives fuel/air mixture, and a plurality of runners extending from the receiver to convey mixture to respective internal engine combustion chambers, the receiver having an inlet opening, a lateral wall, a sidewall between the inlet opening and the lateral wall, and an exit opening to each runner in the sidewall; and an insert in said receiver comprising body having a boundary surface in the path of mixture flowing into the receiver from the inlet opening and having an axis facing toward and substantially aligned with said incoming mixture, the portion of the boundary surface which is to be placed nearest to said inlet opening having a surface perimeter extending in planes normal to said axis, which surface is non-circular and at least in part relieved to form concave lines with said normal planes in order to form with the sidewall a plurality of paths for flow of said mixture, the portion of the boundary surface which is to be remote from the inlet opening having a surface configuration to encourage flow of mixture through the exit ports.

18. A combination according to claim 17 in which the remote portion is generally concave in horizontal planes.

19. A combination according to claim 17 in which the remote portion is generally concave in vertical planes.

20. A combination according to claim 17 in which the remote portion is generally concave in both horizontal and vertical planes.

21. A combination according to claim 17 in which the remote portion includes a plurality of spaced-apart deflector regions which are generally concave in horizontal planes.

22. A combination according to claim 17 in which the remote portion includes a plurality of spaced-apart deflector regions which are generally concave in vertical planes.

23. A combination according to claim 17 in which the remote portion includes a plurality of spaced-apart deflector regions which are generally concave in both horizontal and vertical planes.

24. A combination according to claim 17 in combination with means adjustably to move the insert up and down in the receiver.

25. A combination according to claim 24 in which said means is a lever system.

26. A combination according to claim 24 in which said means is a lead screw.

27. A combination according to claim 17 in which the insert is made of material which can be shaped by hand tools.

28. A combination according to claim 17 in which the insert includes a plurality of shoulders disposed donnwardly from the top of the insert to provide for by-pass flow of mixture from side to side of the insert.

29. A combination according to claim 17 in which the exit openings are non-symmetrically disposed in said sidewall relative to the axis of flow of mixture, and in which the contour of the insert is such as suitably to distribute the mixture among the runner.

30. A combination according to claim 29 in which said insert is tapered laterally relative to the axis of flow of mixture from the inlet opening.

31. A combination according to claim 29 in which the insert includes a pair of lobes.

* * * * *